US010285500B2

(12) United States Patent
Stuffel et al.

(10) Patent No.: US 10,285,500 B2
(45) **Date of Patent: *May 14, 2019**

(54) DEVICE AND METHOD FOR FIXING A PUSH ELEMENT

(71) Applicant: Paul Hettich GmbH & Co. KG, Kirchlengern (DE)

(72) Inventors: Andreas Stuffel, Bueckeburg (DE); Juergen Weidlich, Roedinghausen (DE); Marvin Buhmeier, Petershagen (DE); Helmut Meyer, Bueckeburg (DE); Bernd Meyer, Petershagen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/569,171

(22) PCT Filed: May 3, 2016

(86) PCT No.: PCT/EP2016/059885

§ 371 (c)(1),
(2) Date: Oct. 25, 2017

(87) PCT Pub. No.: WO2016/177728

PCT Pub. Date: Nov. 10, 2016

(65) Prior Publication Data

US 2018/0146783 A1 May 31, 2018

(30) Foreign Application Priority Data

May 4, 2015 (DE) ..... 10 2015 106 854

(51) Int. Cl.
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4272* (2017.01);
(Continued)

(58) Field of Classification Search
CPC ..... A47B 88/427; A47B 88/403; A47B 96/06; A47B 88/407; A47B 88/40; A47B 88/423
(Continued)

(56) References Cited

U.S. PATENT DOCUMENTS 5,588,729 A * 12/1996 Berger ..... A47B 88/427 312/330.1
5,737,820 A 4/1998 Ferrari et al.
(Continued)

FOREIGN PATENT DOCUMENTS

AT 506879 * 12/2009
AT 508 544 A4 2/2011
(Continued)

OTHER PUBLICATIONS

International Search Report of PCT/EP2016/059888, dated Jul. 26, 2016.
(Continued)

*Primary Examiner* — Janet M Wilkens
(74) *Attorney, Agent, or Firm* — Collard & Roe, P.C.

(57) ABSTRACT

A device for fixing a push element, in particular a drawer box to a rail of a pull-out guide, the device comprising a clamping mechanism with a receptacle, into which a web-shaped holding part can be inserted, wherein a self-locking clamping element is provided at the receptacle, by which the holding part is secured in a clamping manner against being pulled out. In this way, a particularly stable fixation of the drawer box to a pull-out guide can be achieved.

17 Claims, 5 Drawing Sheets

(52) U.S. Cl.
CPC ..... *A47B 2088/4274* (2017.01); *A47B 2088/4276* (2017.01); *A47B 2088/4278* (2017.01); *A47B 2210/0056* (2013.01)

(58) Field of Classification Search
USPC ..... 384/22; 312/334.7, 223.1, 334.4, 334.5, 312/348.1, 348.2, 334.6, 333
See application file for complete search history.

(56) References Cited

U.S. PATENT DOCUMENTS

| | | | | |
|---|---|---|---|---|
| 6,913,334 | B2 | 7/2005 | Weichelt | |
| 8,056,994 | B2 * | 11/2011 | Chen | A47B 88/427 312/334.14 |
| 8,424,984 | B2 | 4/2013 | Ritter | |
| 8,727,460 | B2 | 5/2014 | Grabher | |
| 8,764,136 | B2 * | 7/2014 | Grabherr | A47B 88/427 312/334.27 |
| 8,854,769 | B1 * | 10/2014 | Liang | A47B 88/427 360/125.51 |
| 9,066,587 | B1 * | 6/2015 | Liang | A47B 88/0422 |
| 9,259,087 | B1 * | 2/2016 | Hsiao | A47B 88/0055 |
| 9,808,083 | B2 * | 11/2017 | Lucas | A47B 88/427 |
| 9,986,829 | B2 * | 6/2018 | McGregor | A47B 88/427 |
| 2003/0234603 | A1 * | 12/2003 | Salice | A47B 88/407 312/334.5 |
| 2004/0095047 | A1 * | 5/2004 | Salice | A47B 88/427 312/332.1 |
| 2004/0227440 | A1 * | 11/2004 | Booker | F16F 9/0218 312/334.1 |
| 2008/0218045 | A1 * | 9/2008 | Moser | A47B 88/427 312/333 |
| 2013/0113356 | A1 * | 5/2013 | Salice | A47B 88/0422 312/334.44 |
| 2013/0257244 | A1 * | 10/2013 | Salice | A47B 88/0418 312/319.1 |
| 2014/0015390 | A1 * | 1/2014 | Grabherr | A47B 88/04 312/334.4 |
| 2014/0175965 | A1 * | 6/2014 | Salice | A47B 88/04 312/334.1 |
| 2014/0210330 | A1 * | 7/2014 | Amann | A47B 88/0422 312/334.1 |
| 2014/0314347 | A1 | 10/2014 | Huang | |
| 2015/0147008 | A1 * | 5/2015 | McGregor | A47B 88/0422 384/22 |
| 2016/0025124 | A1 * | 1/2016 | Roedder | F16B 12/04 403/14 |
| 2016/0128476 | A1 * | 5/2016 | Ng | A47B 88/16 312/333 |
| 2017/0105525 | A1 | 4/2017 | Klaus | |
| 2017/0347794 | A1 * | 12/2017 | McGregor | A47B 88/49 |
| 2018/0140095 | A1 * | 5/2018 | Stuffel | A47B 88/427 |
| 2018/0146782 | A1 * | 5/2018 | Boekhoff | A47B 88/427 |
| 2018/0146783 | A1 * | 5/2018 | Stuffel | A47B 88/427 |

FOREIGN PATENT DOCUMENTS

| | | | |
|---|---|---|---|
| AT | 510714 | * | 6/2012 |
| AT | 512748 | * | 10/2013 |
| AT | 518136 | * | 7/2017 |
| DE | 4301327 | * | 8/1993 |
| DE | 696 14 443 | T2 | 5/2002 |
| DE | 20 2004 001 791 | U1 | 5/2004 |
| DE | 20 2009 017 319 | U1 | 5/2011 |
| DE | 202009013706 | * | 5/2011 |
| DE | 20 2010 007 765 | U1 | 11/2011 |
| DE | 202011004588 | * | 7/2012 |
| DE | 10 2011 000 724 | A1 | 8/2012 |
| DE | 10 2013 104 829 | A1 | 11/2014 |
| DE | 10 2013 104 830 | A1 | 11/2014 |
| DE | 102013104829 | * | 11/2014 |
| DE | 21 2013 000 112 | U1 | 12/2014 |
| DE | 10 2014 104 136 | A1 | 10/2015 |
| EP | 606564 | * | 7/1994 |
| EP | 695523 | * | 2/1996 |
| EP | 1 285 604 | B1 | 10/2005 |
| JP | 2004160224 | * | 6/2004 |
| WO | 2007118632 | * | 10/2007 |
| WO | 2009/149479 | A1 | 12/2009 |
| WO | 2010040273 | * | 4/2010 |
| WO | 2010129303 | * | 11/2010 |
| WO | 2011094776 | * | 8/2011 |
| WO | 2012092634 | * | 7/2012 |
| WO | 2014065523 | * | 5/2014 |
| WO | 2014/180899 | A1 | 11/2014 |
| WO | 2015/120493 | A1 | 8/2015 |

OTHER PUBLICATIONS

German Search Report in DE 10 2015 106 8567 dated Mar. 8, 2016 with English translation of relevant parts.
International Search Report of PCT/EP2016/059887, dated Jul. 26, 2016.
German Search Report in DE 10 2015 106 873.7 dated Mar. 9, 2016 with English translation of relevant parts.
International Search Report in PCT/EP2016/059886, dated Jul. 26, 2016.
German Search Report in DE 10 2015 106 855.9 dated Mar. 8, 2016 with English translation of relevant parts.
International Search Report in PCT/EP2016/059890, dated Jul. 26, 2016.
German Search Report in DE 10 2015 106 852.4 dated Feb. 26, 2016 with English translation of relevant parts.
International Search Report in PCT/EP2016/059885, dated Jul. 26, 2016.
German Search Report in DE 10 2015 106 854.0 dated Feb. 29, 2016 with English translation of relevant parts.

* cited by examiner

DEVICE AND METHOD FOR FIXING A PUSH ELEMENT

CROSS REFERENCE TO RELATED APPLICATIONS

This application is the National Stage of PCT/EP2016/059885 filed on May 3, 2016, which claims priority under 35 U.S.C. § 119 of German Application No. 10 2015 106 854.0 filed on May 4, 2015, the disclosures of which are incorporated by reference. The international application under PCT article 21(2) was not published in English.

BACKGROUND OF THE INVENTION

The present invention relates to a device for fixing a push element, in particular a drawer, on a rail of a pullout guide, comprising a clamping mechanism having a receptacle into which a web-shaped holding part is insertable, wherein a self-locking clamping element is provided on the receptacle, by means of which the holding part is secured in a friction-locked manner against pulling out, and a method for fixing a push element.

EP 1 285 604 discloses a device for fixing a drawer on a rail of a pullout guide, in which a base part fastenable on the drawer and a catch element fixable on the pullout guide are provided. The catch element is displaceable in relation to the base part within certain tolerances for a compensation of the distance of the guide rails of the pullout guides. Due to the formation of the catch element and the base part as plastic parts, the holding forces are limited, in particular in the case of heavy drawers, which are moved in the pullout direction up to the maximum pullout position. In addition, it is desirable to position the drawers as exactly as possible within the furniture body to obtain an appealing front panel alignment.

WO 2009/149479 discloses a device for the detachable coupling of a drawer to a pullout guide, in which a holding part and a counter holding part are connected to one another via an elastic material piece. This results in a reduction of the position accuracy in the longitudinal direction. In the lateral direction, the drawer can be fixed via a catch device on the rail. In the standardized impact tests for drawers, in which the drawers are pulled out with load, however, only comparatively low holding forces of such a catch connection result.

SUMMARY OF THE INVENTION

It is therefore the object of the present invention to provide a device and a method for fixing a movable furniture part, in which high holding forces can be provided.

This object is achieved by a device and a method according to the invention as described below.

The device according to the invention for fixing a push element comprises a clamping mechanism having a receptacle, into which a web-shaped holding part is insertable, wherein a self-locking clamping element is provided on the receptacle, by means of which the holding part is secured in a friction-locked manner against being pulled out. Particularly stable fixing of the push element can thus be performed via the self-locking clamping element, in particular also with regard to impact tests, in which the drawer is moved in the loaded state into the maximally open position. The self-locking clamping element of the clamping mechanism ensures fixing of the holding part such that it cannot be pulled out again in the opening direction from the receptacle.

Inserting the holding part into the receptacle of the clamping mechanism is comparatively simple, in contrast, since only slight friction forces have to be overcome, so that the installation can be made simple. In addition, continuous fixing of the holding part can be caused by a non-positive connection of the clamping element, which enables particularly accurate positioning of the push element in the opening direction.

A friction-locked or non-positive connection according to the invention differs from a formfitting connection in that the holding forces are provided by friction forces and not by formfitting stop elements, such as projections, teeth, or stops. A continuous adjustment, which is independent of stop elements, can thus be obtained with non-positive fixing of the holding part.

The web-shaped holding part can have a substantially flat surface for the non-positive connection, which is regionally in contact with a contact surface on the clamping element. The holding part can be produced as strip-shaped, angled, U-shaped, as a hollow profile, or having other geometries, in particular from metal, wherein only a section of a profile can be used for the non-positive connection. The holding part can also be formed by a section of the pullout guide profile.

The clamping element is preferably designed as a clamping lever and is mounted so it is rotatable about a rotational axis. In this case, the clamping element can be pre-tensioned in a locked position, in particular via one or more springs and/or via a force accumulator. It is also possible to form the clamping element as a clamping wedge or to mount the clamping element so it is displaceable along a curve guide.

According to one preferred embodiment of the invention, means are provided for unlocking the clamping element, by means of which the non-positive connection of the clamping element can be disengaged from the holding part. A traction element can be provided for unlocking the clamping element, by means of which the clamping element can be disengaged from the holding part. In this case, the contact surface of the clamping element only has to be moved slightly away from the holding part to release the holding part.

The clamping element preferably presses via a linear contact surface against the holding part, which extends in parallel to the rotational axis of the clamping element. The contact surface can be formed as sharp-edged, rounded, or having another contact contour in this case, to provide high clamping forces. The high clamping forces are generated in this clamping system by a force multiplication by the lever effect.

Instead of a rotational axis on which the clamping element is mounted, the clamping element can also be fastened so that it fulfills the function by bending the clamping element.

The holding part can preferably be continuously fixed on the clamping mechanism, so that during the installation, the drawer is placed on the pullout guide and pushed in slightly, the holding part is already fixed on the clamping mechanism, the installer has certainty that the drawer cannot slip unintentionally from the pullout guide in the opening direction as it is pulled out. Rather, the clamping mechanism is activated as soon as the holding part is guided past the clamping element in the receptacle. Subsequent further pushing in of the drawer for a continuous adjustment is possible without problems in this case.

For particularly stable fastening of the drawer, the holding part and the contact surface of the clamping lever pressing against the holding part can be produced from metal, for example, from a steel plate. In contrast to metal, plastic flows, so that only lesser forces can be absorbed via the clamping mechanism, wherein the use of plastics, in particular reinforced plastics, is entirely possible.

The rotational axis of the clamping lever is preferably arranged in front of a contact surface of the clamping lever on the holding part in the insertion direction. Self-locking is thus caused, wherein in the installed position, an angle between the contact surface of the clamping lever in relation to the rotational axle can be arranged at an angle in relation to the longitudinal direction of the holding part between 55° and 89°, in particular 70° to 85°. The free running direction and the blocking direction in the clamping system are defined by the angle position of the clamping lever. If the holding part is loaded in the blocking direction, a self-reinforcing effect occurs, so that with increased load of the holding part in the blocking direction, the clamping force also increases.

For simple installation, the receptacle can be formed on the fastening part, on which the clamping lever is mounted so it is rotatable. The clamping lever can then be preinstalled with the receptacle as a unit on the rail or the drawer. The fastening part is preferably mounted so it is displaceable on or in a housing. The fastening part can thus be moved via means for lateral adjustment in relation to the housing, so that an exact alignment of the drawer is also possible perpendicularly to the movement direction of the pullout guide in the horizontal direction. A height adjustment and/or a depth adjustment can also be provided.

BRIEF DESCRIPTION OF THE DRAWINGS

The invention will be explained in greater detail hereafter on the basis of two exemplary embodiments with reference to the appended drawings. In the figures.

DETAILED DESCRIPTION OF THE INVENTION

Figure 1:
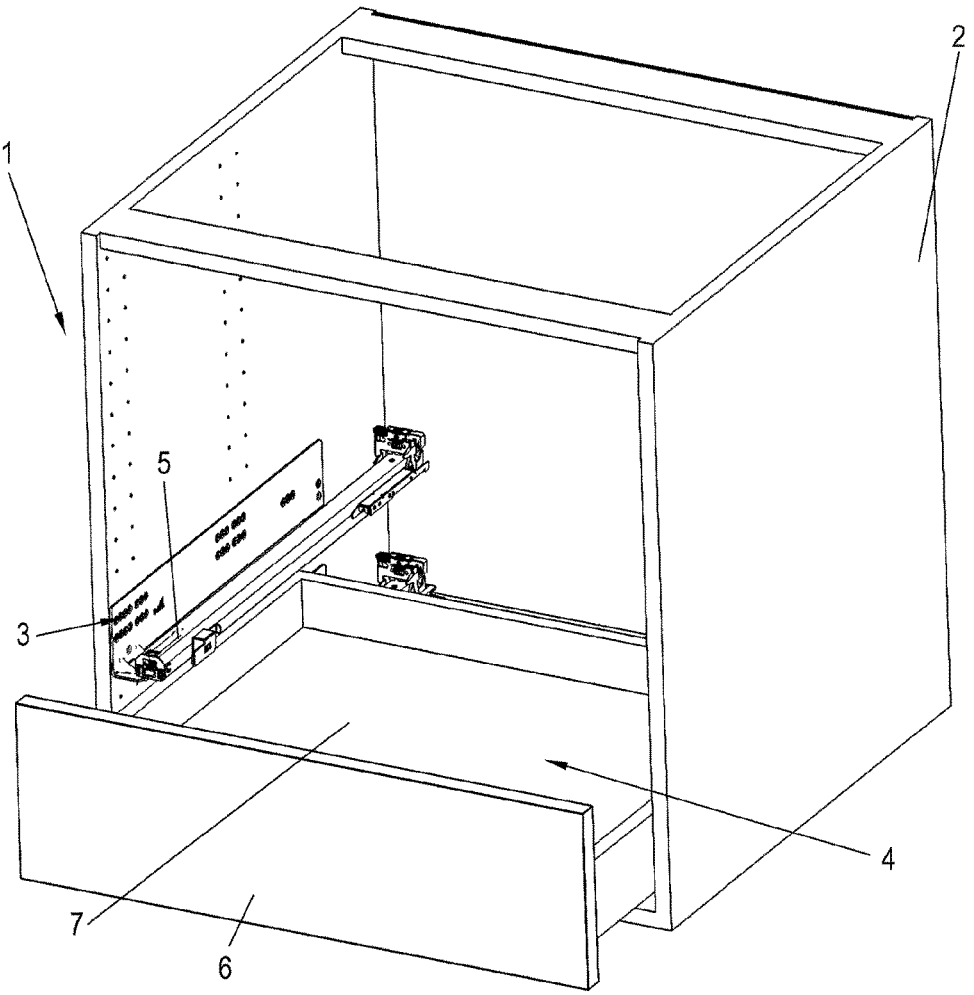
FIG. 1 shows a perspective view of an item of furniture having a drawer.

An item of furniture 1 comprises a furniture body 2, on the side walls of which one or more pullout guides 3 are fixed, which have at least one movable rail 5. A drawer 4 is held so it is movable on two such rails 5, wherein a device 10 for fixing the drawer 4 on the rail 5 is provided for this purpose on each rail 5, as is recognizable from the bottom view of FIG. 2. A first device 10 having lateral adjustment for fixing the drawer and a second device 10 without lateral adjustment for fixing the drawer are fixed on a rail 5 on a bottom 7 of the drawer 4. Each device 10 comprises a housing 15 in this case, which is fixed on a front panel 6 and/or the bottom 7 of the drawer 4.

Figure 2:
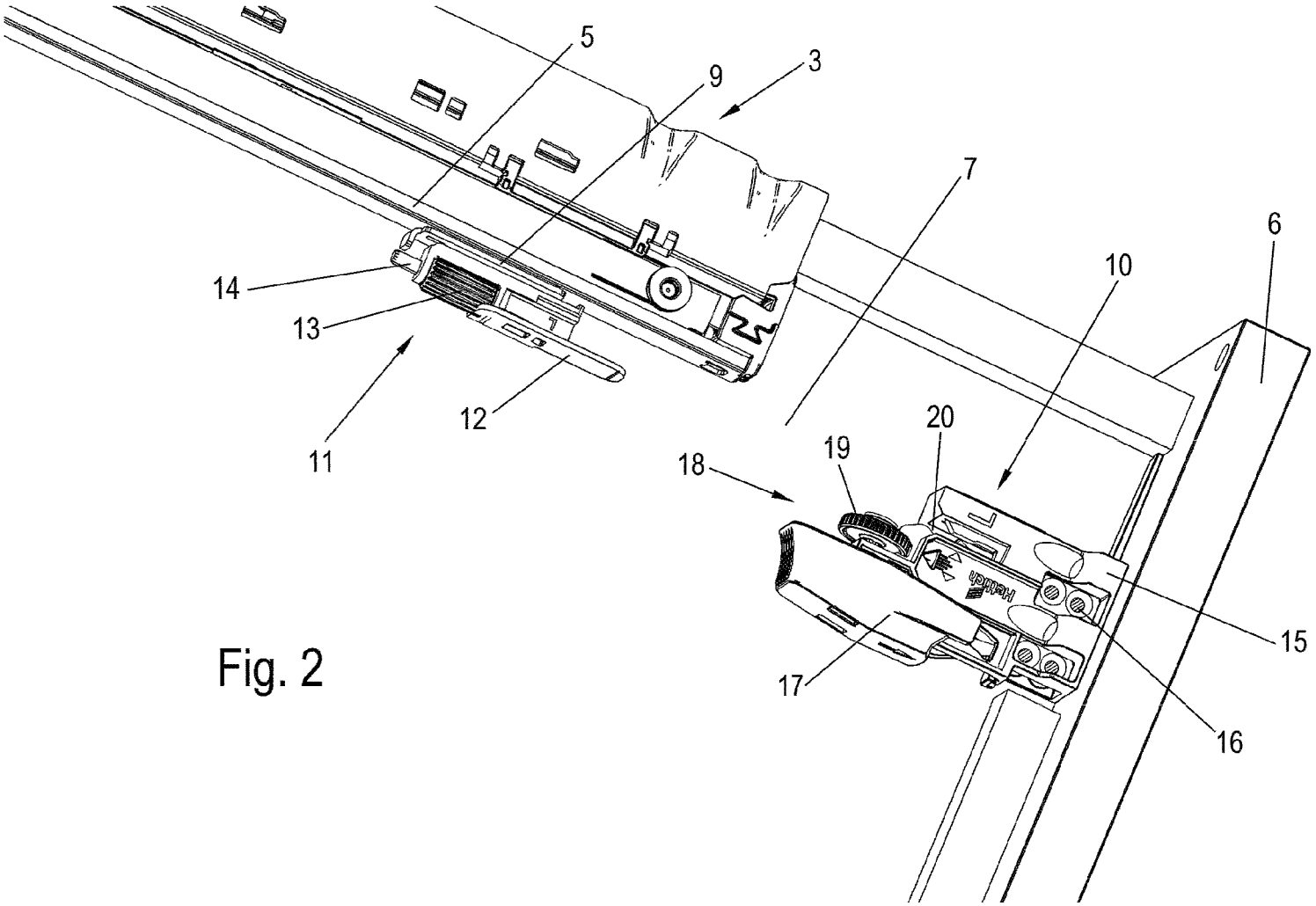
FIG. 2 shows a perspective detail illustration of a drawer having the device according to the invention for fixing the drawer during the installation in the non-connected state.

In the detail view of FIG. 2, the device 10 is shown during the installation. The housing 15 can be fixed via fastening means 16 on the lower side of the drawer 4, wherein a receptacle 20 is provided for inserting a holding part 12. The holding part 12 is held on the rail 5 of the pullout guide 3. In this case, the web-shaped holding part 12 can optionally be fixed via an integrally formed tab 9 on the rail 5 or can be formed as a separate component which is fixed on the rail 5 or is fixed on the rail 5 via further components, or the holding part 12 is a part of the rail profile of the rail 5. A unit 11 for depth adjustment is provided on the tab 9, which has a rotationally-fixed, but axially-displaceable mounted threaded bolt 14, on which a knurled nut 13 is mounted so it is rotatable, but axially immovable. The threaded bolt 14 can thus be moved in the longitudinal direction of the rail 5 by rotating the knurled nut 13 and can therefore move a stop which specifies the maximum insertion depth of the holding part 12 into the receptacle 20. Such a unit 11 for depth adjustment can optionally also be omitted.

For the installation, the drawer 4 is placed on the two rails 5 of the two pullout guides 3 and pushed into the closed position. In this case, a web-shaped holding part 12 is inserted into the receptacle 20 of the device 10 or 10', respectively, on each of the opposing sides and fixed via a clamping mechanism, which secures the holding part 12 in a clamping and friction-locked manner against pulling out. A lateral front panel alignment can be adapted via a unit 18 for lateral adjustment. The unit 18 for lateral adjustment comprises a knurled nut 19, which causes the receptacle 20 to be moved laterally in the horizontal direction in relation to the housing 15 by rotation, to perform a lateral adjustment.

Figure 3:
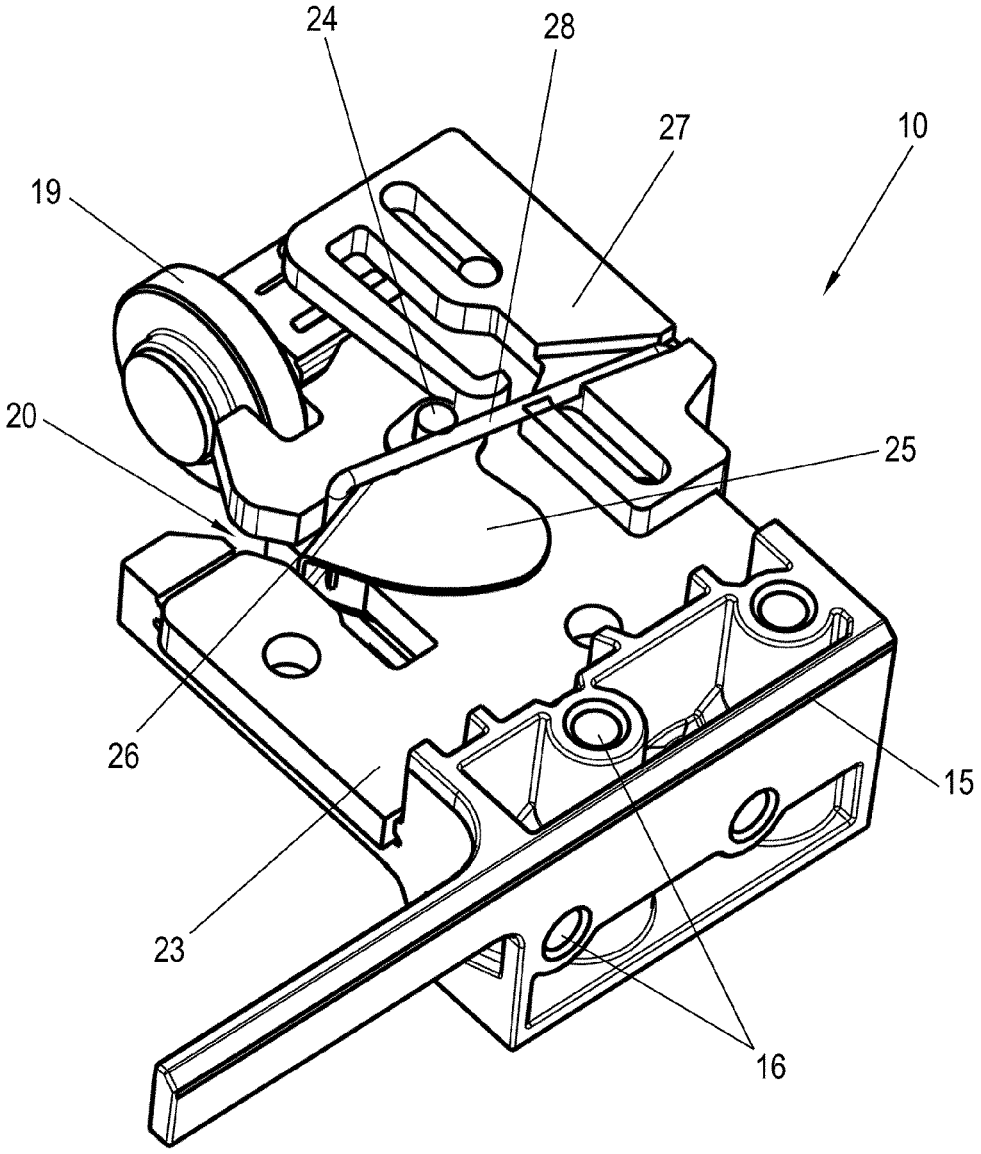
FIG. 3 shows a perspective view of the device of FIG. 2 without holding part.
Figure 4:
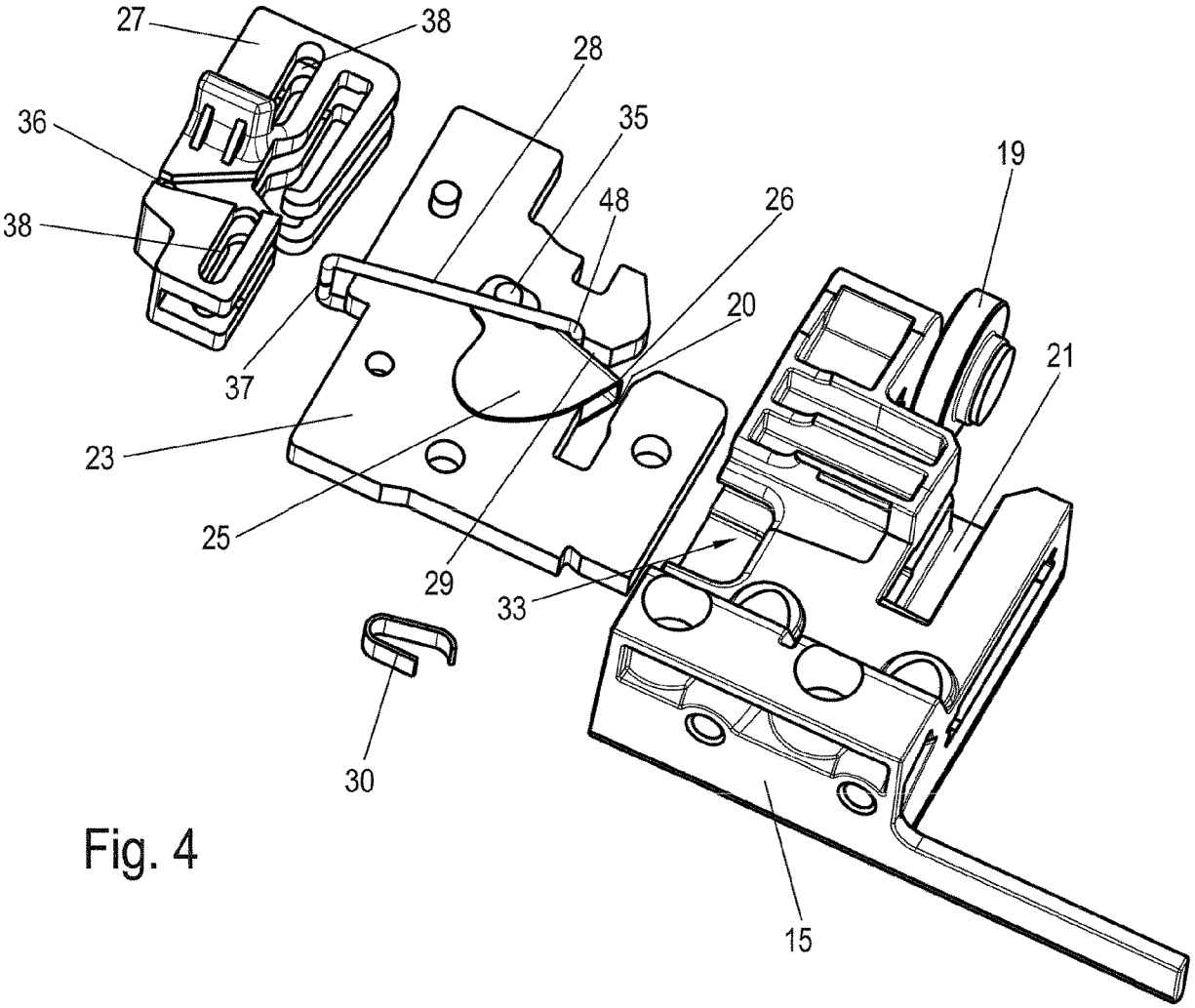
FIG. 4 shows a perspective exploded illustration of the device of FIG. 3.

FIGS. 3 and 4 show the device 10, on which a receptacle 20 for receiving the holding part 12 is formed. The device 10 comprises a plate-shaped fastening part 23, on which the clamping lever 25 is mounted so it is rotatable about a rotational axis 24 and is pre-tensioned by a spring 30 in the locked position. The clamping lever 25 can also be fastened differently or embodied in one piece with the fastening plate. If the clamping lever is not mounted so it is rotatable, the clamping lever can fulfill its function by bending. The clamping lever 25 is produced here from a bent metal plate, which encloses a section of the plate-shaped fastening part 23 in a U shape. A contact surface 26, which presses as a linear contact against the holding part 12, is formed in this case on the bottom of the U.

Furthermore, a modified slide 27 is provided on the fastening part 23, which has a different shape than the slide 17 in FIG. 2, but is also used for unlocking the clamping lever 25. For this purpose, a holder 36 is provided on the slide 27, to actuate the means for unlocking 28, which comprise a traction element which engages with a section 37 in the holder 36. The traction element is arranged on the opposite side with a section 48 in a wedge-shaped gap 29 between the clamping lever 25 and the fastening part 23. By pulling the traction element, the clamping lever 25 can be pivoted against the force of a spring into the unlocking position. Oblong holes 38, which are penetrated by pins 39, are provided on the slide 27 to guide the slide 27 accordingly.

Figure 5A:
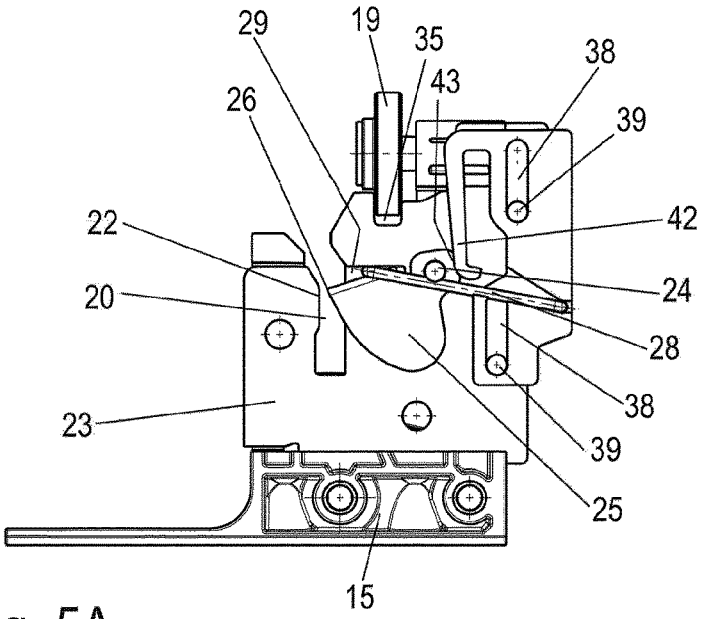
FIGS. 5A and 5B show two views of the device of FIG. 3 in the locked and unlocked position.
Figure 5B:
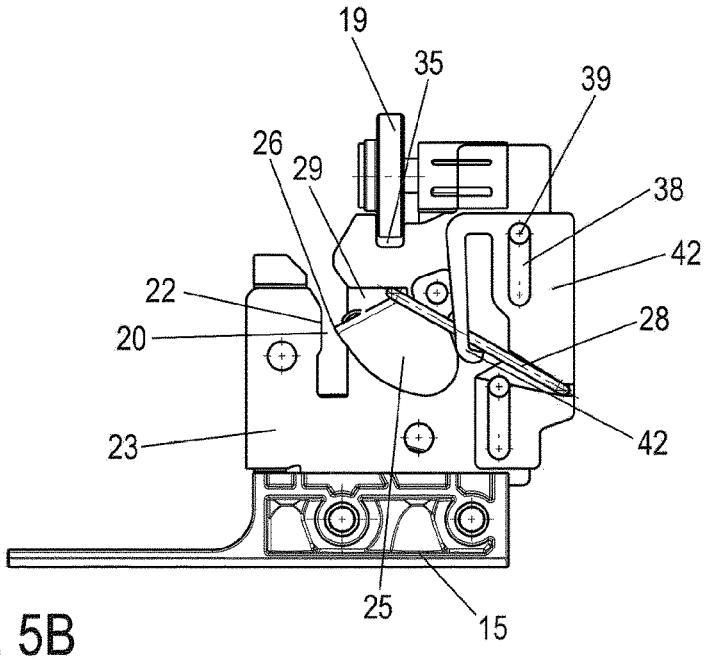

FIG. 5A shows the clamping lever 25 in the locked position, but without holding part 12. The slide 27 has spring elements 42, which are supported against a section of the means for unlocking 28 and thus hold the slide 27 in its starting position. To unlock the clamping lever 25, the slide 27 is moved against the force of the spring elements 42 along the oblong holes 38 until the position shown in FIG. 5B is reached. By displacing the slide 27, the traction element of the means 28 for unlocking the clamping lever 25 is moved, which is moved along the gap 29 and thus has pivoted the clamping lever 25 counterclockwise. The gap between the contact region 26 of the clamping lever 25 and the opposing side wall 22 is thus enlarged, so that the holding part 12 can be pulled out of the receptacle 20 nondestructively.

The plate-shaped fastening part 23 is inserted into a receptacle 33 on the housing 15. Furthermore, a recess 21 is formed on the housing 15 in the region of the receptacle 20. The fastening part 23 has a receptacle 35 for inserting an edge section of the knurled nut 19, so that the fastening part 23 can be displaced in relation to the housing 15 for a lateral adjustment.

In the illustrated exemplary embodiment, both the clamping lever 25 and also the fastening part 23 consist of metal, in particular a steel plate. Particularly high holding forces can thus be applied to the holding part 12, which is also metallic.

LIST OF REFERENCE NUMERALS

1 furniture
2 furniture body
3 pullout guide
4 drawer
5 rail
6 front panel
7 bottom
9 tab
10, 10' device
11 unit
12 holding part
13 knurled nut
14 threaded bolt
15 housing
16 fastening means
17 slide
18 unit
19 knurled nut
20 receptacle
22 side wall
23, 23' fastening part
24 rotational axis
25 clamping lever
26 contact region
27 slide
28 means for unlocking
29 gap
30 spring
33 receptacle
35 receptacle
36 holder
37 section
30 oblong holes
39 pin
42 spring element
48 section

What is claimed is:

1. A device for fixing a push element in the form of drawer (4) on a rail (5) of a pullout guide (3), comprising a clamping mechanism having a receptacle (20), into which a web-shaped holding part (12) is insertable, wherein a self-locking clamping element (25) in the form of a clamping lever is provided on the receptacle (20) so as to be rotatable about a rotational axis, by which clamping lever the holding part (12) is secured in a friction-locked manner against pulling out, wherein the rotational axis (24) of the clamping element (25) is arranged before a linear contact region (26) of the clamping element (25) on the holding part (12) in an insertion direction.

2. The device according to claim 1 wherein the clamping element (25) is pre-tensioned in the locked position.

3. The device according to claim 1, wherein a device (28) for unlocking the clamping element (25) is provided, by which the clamping element (25) can be disengaged from the holding part (12).

4. The device according to claim 3, wherein the device (28) for unlocking comprises a traction element, by which the clamping element (25) is movable into an unlocked position.

5. The device according to claim 4, wherein the traction element is designed as a wire bow, which is movable in a wedge-shaped gap (29) between the clamping element (25) and a fastening part (23).

6. The device according to claim 3, wherein the device (28) for unlocking can be actuated via a guided slide (27).

7. The device according to claim 1, wherein the clamping element (25) presses via the linear contact region (26) against the holding part (12), which extends substantially in parallel to the rotational axis (24) of the clamping element (25).

8. The device according to claim 1, wherein the holding part (12) is continuously fixable on the clamping mechanism.

9. The device according to claim 1, wherein a surface of the clamping element (23) pressing against the holding part (12) and the holding part (12) are produced from metal.

10. The device according to claim 1, wherein the receptacle (20) is formed on a fastening part (23), on which the clamping element (25) is mounted so it is rotatable or bendable.

11. The device according to claim 10, wherein the fastening part (23) is mounted so it is displaceable on or in a housing (15).

12. The device according to claim 11, wherein the fastening part (23) is movable via a device (19) for lateral adjustment in relation to the housing (15).

13. The device according to claim 1, wherein the clamping element (25) is actuated by bending.

14. The device according to claim 1, wherein a fastening part (23) is provided, on which the clamping element (25) is indirectly or directly arranged, or the clamping element (25) is embodied in one piece with the fastening part (23).

15. The device according to claim 1, wherein the holding part (12) or the clamping mechanism is configured to be arranged on a front-side region of the drawer (4).

16. An item of furniture (1) comprising a furniture body (2) and at least one drawer (4), which is held so it is movable via two pullout guides (3) on the furniture body (2), wherein at least one pullout guide (3) is connected to the drawer (4) via the device according to claim 1.

17. A method for fixing a push element in the form of a drawer (4) on a rail (5) of a pullout guide (3), comprising a clamping mechanism having a receptacle (20), into which a web-shaped holding part (12) is insertable, wherein a self-locking clamping element (25) in the form of a clamping lever is provided on the receptacle (20) so as to be rotatable around a rotational axis, by which clamping lever the holding part (12) is secured in a friction-locked manner against pulling out, wherein the rotational axis (24) of the clamping element (25) is arranged before a linear contact region (26) of the clamping element (25) on the holding part (12) in an insertion direction and wherein the friction-locked connection is canceled by actuating a button or a slide (17, 27) and the holding part (12) is removable from the clamping mechanism.

* * * * *